US009329568B1

(12) United States Patent
Kashimoto et al.

(10) Patent No.: US 9,329,568 B1
(45) Date of Patent: May 3, 2016

(54) DEVELOPING DEVICE AND IMAGE FORMING APPARATUS

(71) Applicant: KYOCERA Document Solutions Inc., Osaka (JP)

(72) Inventors: Masahiro Kashimoto, Osaka (JP); Hirofumi Tsuji, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/950,563

(22) Filed: Nov. 24, 2015

(30) Foreign Application Priority Data

Dec. 12, 2014 (JP) ..... 2014-252469

(51) Int. Cl.
*G03G 21/16* (2006.01)

(52) U.S. Cl.
CPC ..... *G03G 21/1676* (2013.01)

(58) Field of Classification Search
CPC ..... G03G 21/1676; G03G 15/0813
USPC ..... 399/119, 228
See application file for complete search history.

(56) References Cited

U.S. PATENT DOCUMENTS 4,851,873 A * 7/1989 Sakao ..... 399/119
7,076,187 B2 * 7/2006 Jeong
7,519,312 B2 4/2009 Izumi et al.
2007/0048009 A1 3/2007 Izumi et al.
2015/0055978 A1 * 2/2015 Izumi ..... 399/119

FOREIGN PATENT DOCUMENTS

JP 2007-094386 A 4/2007
JP 2008-009295 A 1/2008
JP 2012-237849 A 12/2012

* cited by examiner

*Primary Examiner* — Walter L Lindsay, Jr.
*Assistant Examiner* — Milton Gonzalez

(57) ABSTRACT

A developing device includes a developing roller and a transfer mechanism configured to transfer the developing roller between a contact position where the developing roller is in contact with a photosensitive drum and a separate position where the developing roller is away from the photosensitive drum. The transfer mechanism includes a bearing unit supporting a rotary shaft of the developing roller to allow rotation of the rotary shaft, a pressing member pressing the bearing unit, a shaft member, an urging member, and a wire member. The wire member connects the bearing unit and the shaft member and is configured to experience an urging force of the urging member to urge the bearing unit toward moving away from the photosensitive drum and, upon release of the urging force of the urging member, move the bearing unit close to the photosensitive drum under a pressing force of the pressing member.

7 Claims, 10 Drawing Sheets

DEVELOPING DEVICE AND IMAGE FORMING APPARATUS

INCORPORATION BY REFERENCE

This application claims priority to Japanese Patent Application No. 2014-252469 filed on Dec. 12, 2014, the entire contents of which are incorporated by reference herein.

BACKGROUND

The present disclosure relates to developing devices and image forming apparatuses with the same and particularly relates to a mechanism for moving a developing roller into and out of contact with an image carrier.

Electrophotographic image forming apparatuses are provided with developing devices in which a developing roller supplies a developer to an electrostatic latent image formed on a photosensitive drum (image carrier) to generate a toner image. In such a developing device, in order to enable the supply of the developer, the developing roller is disposed close to the photosensitive drum to the point of almost making contact with the photosensitive drum. Meanwhile, in order to enable the removal of the developing device without damaging the photosensitive drum at the time of maintenance, the developing device is provided with a mechanism for moving the developing roller from the position close to the photosensitive drum to a position away from it.

For example, there is known an image forming apparatus which includes a developing roller transfer mechanism composed of: an arm member mounted to a developing roller for unitary rotation with the developing roller; and a shaft member disposed movably along an axial direction of the developing roller and allowing the unitary rotation of the arm member with the developing roller while moving in the axial direction. There is also known a developing roller transfer mechanism configured to smoothly slide the shaft member using a slide auxiliary member.

SUMMARY

A technique improved over the above techniques is proposed herein as one aspect of the present disclosure.

A developing device according to an aspect of the present disclosure includes a developing roller and a transfer mechanism.

The developing roller is configured to supply a developer to an electrostatic latent image formed on an image carrier.

The transfer mechanism is configured to transfer the developing roller between a contact position where the developing roller is in contact with the image carrier and a separate position where the developing roller is away from the image carrier.

The transfer mechanism includes a bearing unit, a pressing member, a shaft member, an urging member, and a rod member.

The bearing unit supports a rotary shaft of the developing roller to allow rotation of the rotary shaft and is pivotally supported by a housing covering the developing roller and the transfer mechanism.

The pressing member is configured to press the bearing unit toward bringing the bearing unit close to the image carrier.

The shaft member is mounted to the housing reciprocally movably in an axial direction of the developing roller.

The urging member urges the shaft member unidirectionally in the axial direction.

The rod member connects the bearing unit and the shaft member and is configured to experience a unidirectional urging force of the urging member to urge the bearing unit toward moving away from the image carrier against a pressing force of the pressing member and, upon release of the urging force of the urging member resulting from movement of the shaft member in a direction opposite to the unidirectional urging force, move the bearing unit close to the image carrier under the pressing force of the pressing member.

An image forming apparatus according to another aspect of the present disclosure includes the developing device, the image carrier, an exposure device, and an image transfer device.

The image carrier is configured to be supplied with the developer from the developing roller.

The exposure device is configured to expose a surface of the image carrier to light to generate the electrostatic latent image.

The image transfer device is configured to transfer from the image carrier to an image transfer member a toner image formed by developing the electrostatic latent image with the developer supplied from the developing roller.

DETAILED DESCRIPTION

Figure 1:
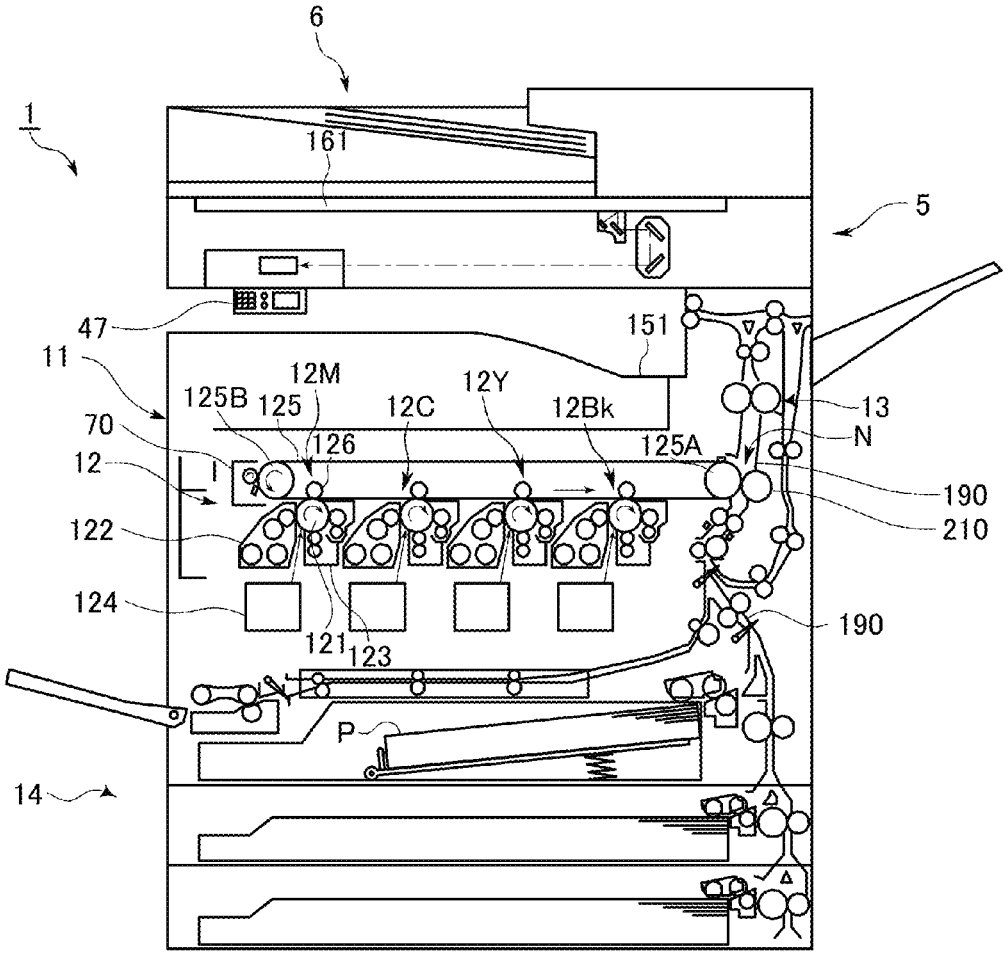
FIG. 1 is a front cross-sectional view showing the structure of an image forming apparatus including a developing device according to one embodiment of the present disclosure.

Hereinafter, a description will be given of a developing device and an image forming apparatus with the same, both according to one embodiment of the present disclosure, with reference to the drawings. FIG. 1 is a front cross-sectional view showing the structure of the image forming apparatus including the developing device according to the one embodiment of the present disclosure.

The image forming apparatus 1 according to the one embodiment of the present disclosure is a multifunction peripheral having multiple functions including, for example, a copy function, a print function, a scan function, and a facsimile function. The image forming apparatus 1 is made up so that an apparatus body 11 thereof includes an operating section 47, an image forming section 12, a fixing section 13, a sheet feed section 14, a document feed section 6, an image reading section 5, and so on.

The operating section 47 is configured to receive, from an operator, instructions for various types of operations and processing executable by the image forming apparatus 1, such as an instruction to perform an image forming operation and an instruction to perform a document reading operation.

In a document reading operation of the image forming apparatus 1, the image reading section 5 optically reads an image of an original document being fed by the document feed section 6 or an image of an original document placed on an original glass plate 161 to generate image data. The image data generated by the image reading section 5 is stored on an internal HDD, a network-connected computer or the like.

In an image forming operation of the image forming apparatus 1, the image forming section 12 forms a toner image on a recording paper sheet P serving as a recording medium fed from the sheet feed section 14, based on image data generated by the document reading operation, image data received from a network-connected computer, image data stored on the internal HDD, or other image data. Each of image forming units 12M, 12C, 12Y, and 12Bk of the image forming section 12 includes a photosensitive drum 121, a developing device 122 operable to supply toner to the photosensitive drum 121, a toner cartridge (not shown) for holding the toner, a charging device 123, an exposure device 124, and a primary transfer roller 126.

In performing color printing, the image forming unit 12M for magenta, the image forming unit 12C for cyan, the image forming unit 12Y for yellow, and the image forming unit 12Bk for black in the image forming section 12 form respective toner images on their respective photosensitive drums 121 through charging, exposure, and developing processes based on respective images of respective different color components constituting the image data and then allow their respective primary transfer rollers 126 to transfer the toner images to an intermediate transfer belt 125 mounted around a drive roller 125A and a driven roller 125B.

The intermediate transfer belt 125 has an outer peripheral surface set as an image carrying surface to which a toner image is to be transferred, and is configured to be driven by the drive roller 125A while engaging against the peripheral surfaces of the photosensitive drums 121. The intermediate transfer belt 125 is configured to travel in an endless path between the drive roller 125A and the driven roller 125B while synchronizing with each photosensitive drum 121.

The toner images of different colors transferred to the intermediate transfer belt 125 are superposed each other on the intermediate transfer belt 125 by controlling their transfer timings, resulting in a multicolor toner image. A secondary transfer roller 210 is configured to transfer the multicolor toner image formed on the surface of the intermediate transfer belt 125, at a nip N between the secondary transfer roller 210 and the drive roller 125A with the intermediate transfer belt 125 in between, to a recording paper sheet P conveyed from the sheet feed section 14 along a conveyance path 190. Thereafter, the fixing section 13 fixes the toner image on the recording paper sheet P by the application of heat and pressure. The recording paper sheet P having a multicolor image fixed thereon by the completion of the fixation treatment is discharged to a paper output tray 151.

A cleaning device (cleaning section) 70 is provided at a portion of the intermediate transfer belt 125 mounted around the driven roller 125B. The cleaning device 70 is configured to collect toner remaining on the outer peripheral surface of the intermediate transfer belt 125.

Figure 2:
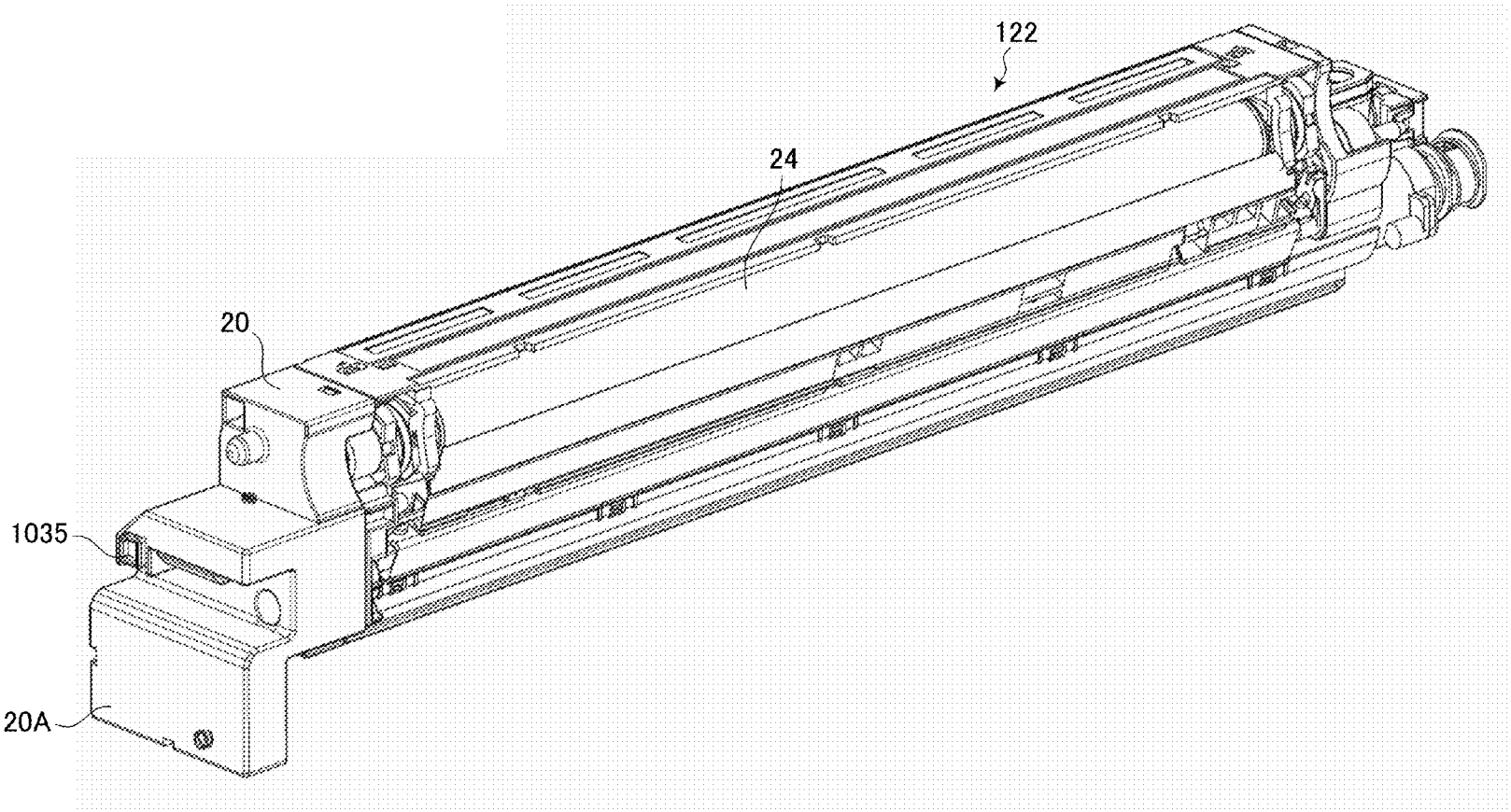
FIG. 2 is a perspective view of the developing device.
Figure 3:
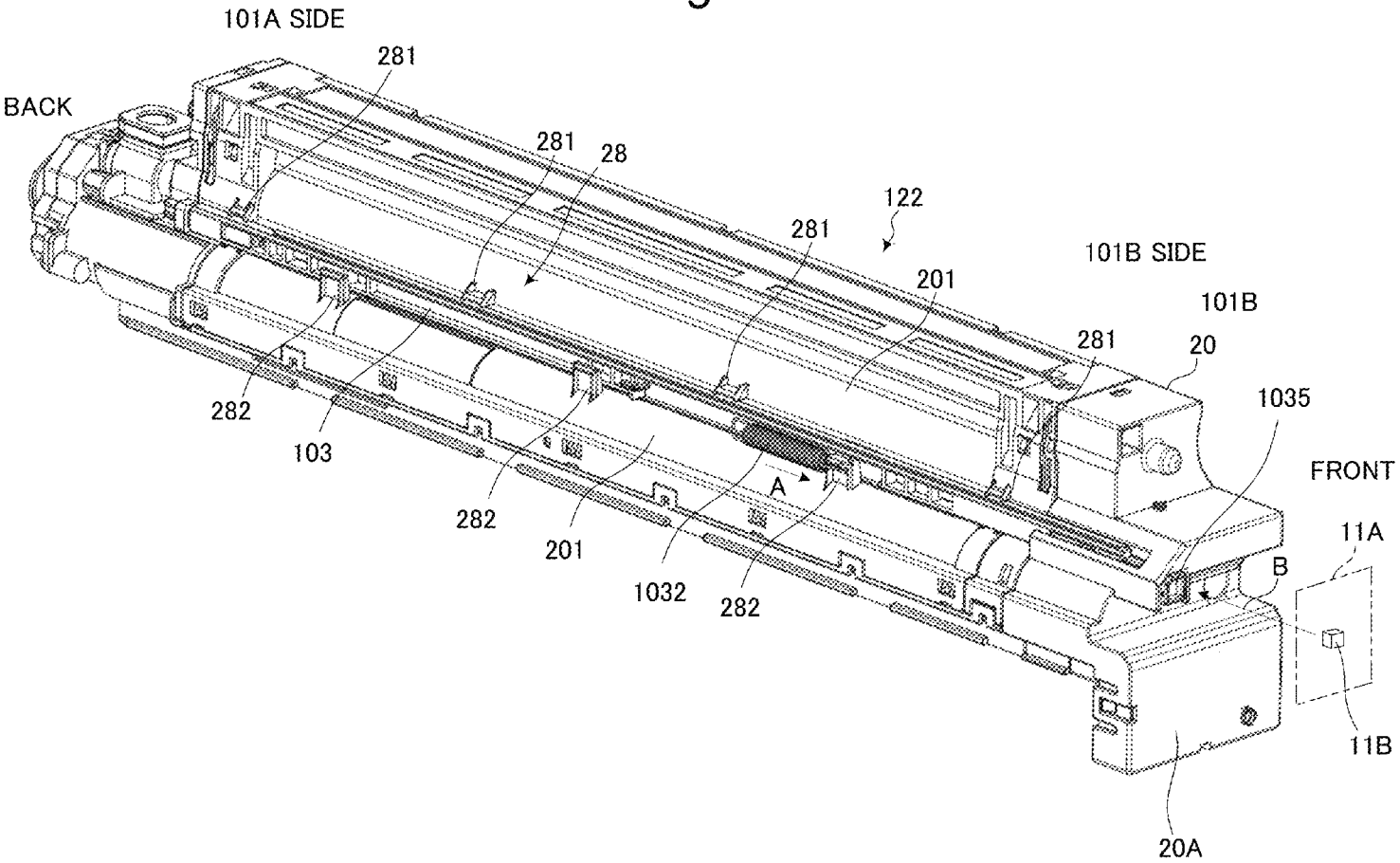
FIG. 3 is a perspective view of the developing device as viewed from a different direction from in FIG. 2.
Figure 4:
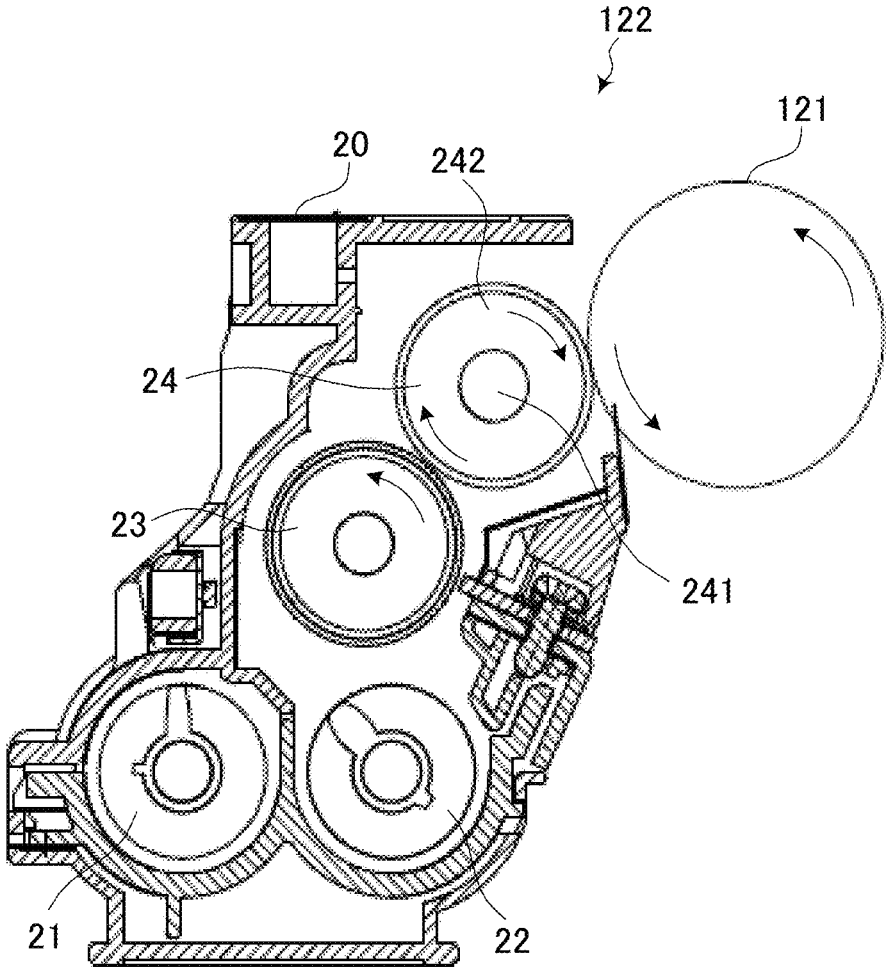
FIG. 4 is a side cross-sectional view of the developing device.

Next, a description will be given of the structure of the developing device 122 provided in each of the image forming units for different colors. FIG. 2 is a perspective view of the developing device 122. FIG. 3 is a perspective view of the developing device 122 as viewed from a different direction from in FIG. 2. FIG. 4 is a side cross-sectional view of the developing device 122. The developing devices 122 provided in the image forming units for different colors have the same structure.

The developing device 122 includes a housing 20 forming an armoring case. The housing 20 is capable of accumulating a toner (an example of a developer) that may be a two-component toner in which case the housing 20 accumulates toner particles and carrier particles. The developing device 122 contains, in the housing 20, a first spiral feeder 21, a second spiral feeder 22, a magnetic roller 23, and a developing roller 24.

The first spiral feeder 21 is configured to receive the toner supplied from an unshown toner container and then convey the toner in a direction along the axis of rotation thereof while agitating the toner. The second spiral feeder 22 is configured to receive the toner transferred from the first spiral feeder 21 and then convey the toner in a direction along the axis of rotation thereof and opposite to the direction of conveyance of the toner in the first spiral feeder 21. The magnetic roller 23 is configured to magnetically collect the toner conveyed by the second spiral feeder 22 and feed it to the developing roller 24. The developing roller 24 is configured to receive the toner conveyed from the magnetic roller 23 and feed it to a latent image region on a peripheral surface of the photosensitive drum 121.

The developing roller 24 includes, for example, a magnet roller 241 and a developing sleeve 242. The developing sleeve 242 is fitted over the peripheral surface of the magnet roller 241. The developing sleeve 242 is disposed adjacent to both the surface of the photosensitive drum 121 and the magnetic roller 23. The developing sleeve 242 and the magnetic roller 23 are rotatably journaled in a pair of bearing units 101 to be described hereinafter. The pair of bearing units 101 are pivotally mounted to the housing 20. The developing sleeve 242 is made into a cylindrical form from a non-magnetic material, such as aluminum, and finished to a surface roughness Rz of, for example, 10 μm or less.

The magnet roller (magnetic body) 241 is a permanent magnet fixed to the interior of the developing sleeve 242. The magnet roller 241 includes a plurality of magnetic poles in which S poles and N poles are alternately arranged in a circumferential direction of the magnet roller 241 and generates a magnetic field toward the developing sleeve 242. Furthermore, the developing roller 24 is exposed through an opening of the housing 20 by the pair of bearing units 101 to be described hereinafter. The developing roller 24 is held at a contact position where it is in contact with the photosensitive drum 121 serving as an image carrier (but, to be exact, at a position where it faces the photosensitive drum 121 at a slight constant distance therefrom). The region where the developing roller 24 faces the photosensitive drum 121 serves as a development region where the toner carried on the developing sleeve 242 is supplied to the photosensitive drum 121. In order to supply the toner to the photosensitive drum 121, for example, a developing bias formed of an alternating current superimposed on a direct current is applied to the developing sleeve 242.

The toner carried on the peripheral surface of the developing sleeve 242 is conveyed toward the development region by the rotation of the developing sleeve 242 (the rotation in the direction of the arrow in FIG. 4). When the developing bias is applied to the developing sleeve 242, a potential difference generates in the development region between the developing sleeve 242 and the photosensitive drum 121, so that the toner on the developing sleeve 242 moves onto the photosensitive drum 121 and the electrostatic latent image on the photosensitive drum is thus developed into a toner image.

Figure 5:
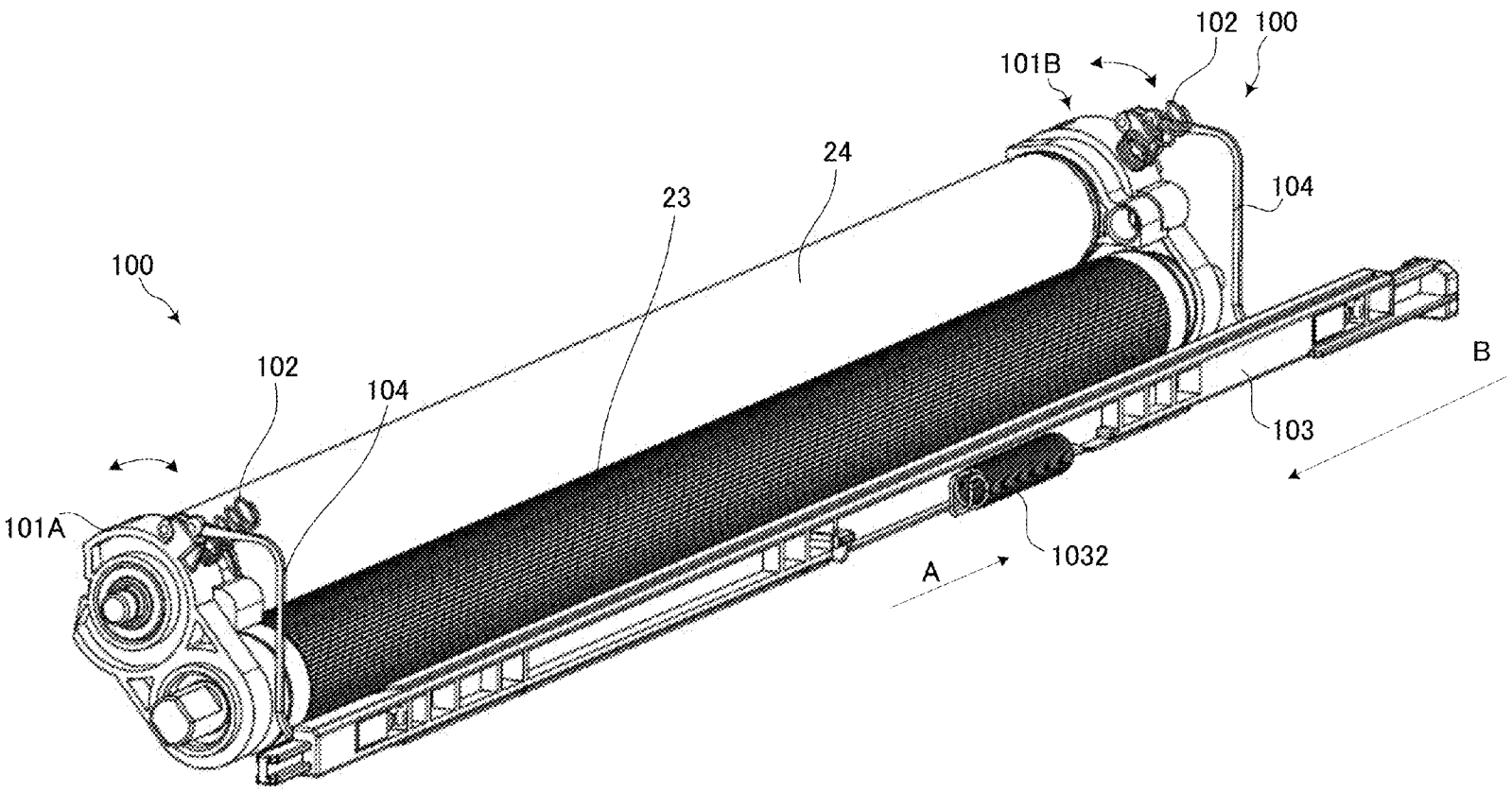
FIG. 5 is a perspective view showing a transfer mechanism for a developing roller.
Figure 6:
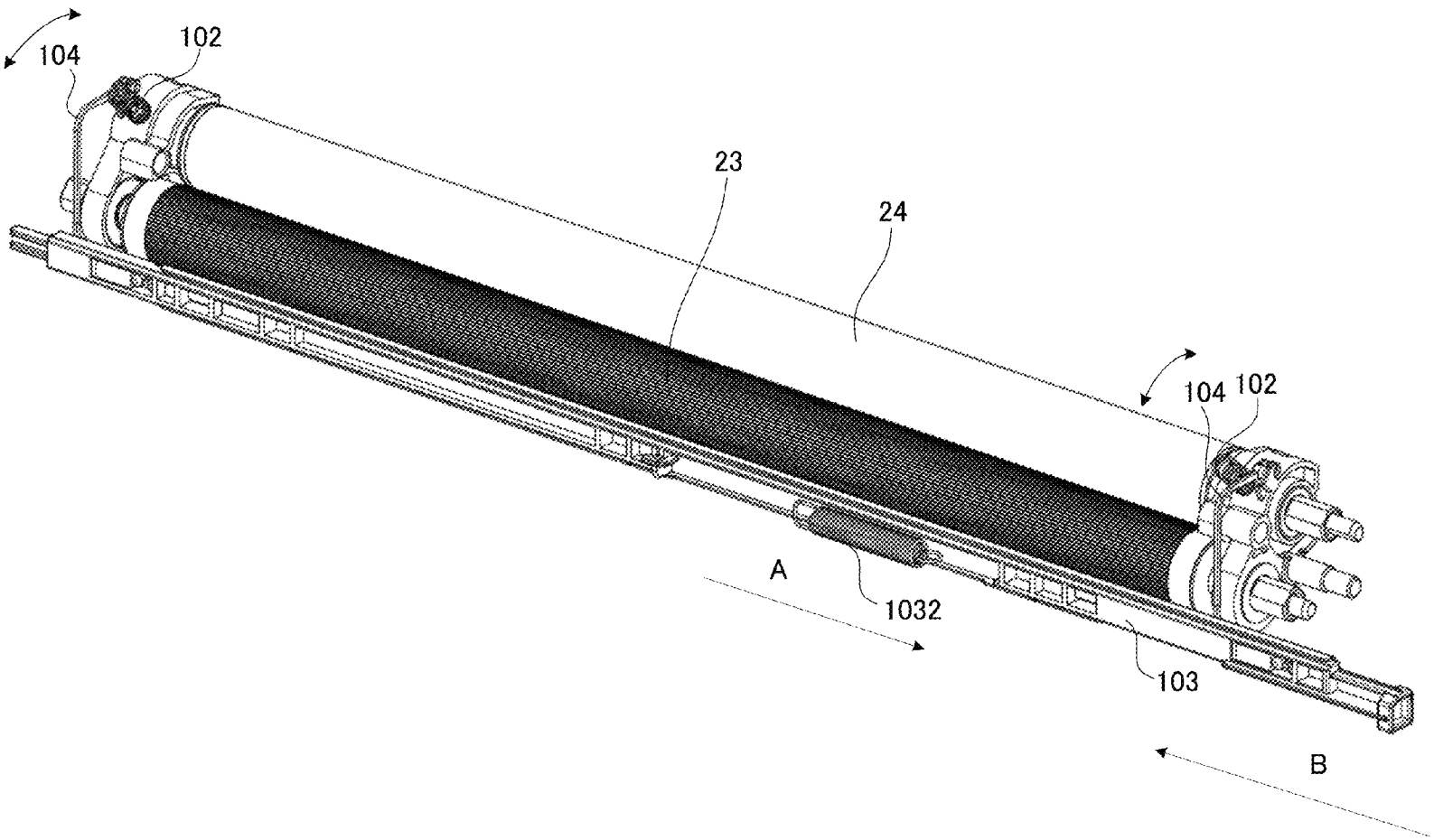
FIG. 6 is a perspective view showing the transfer mechanism for the developing roller as viewed from a different direction from in FIG. 5.
Figure 7:
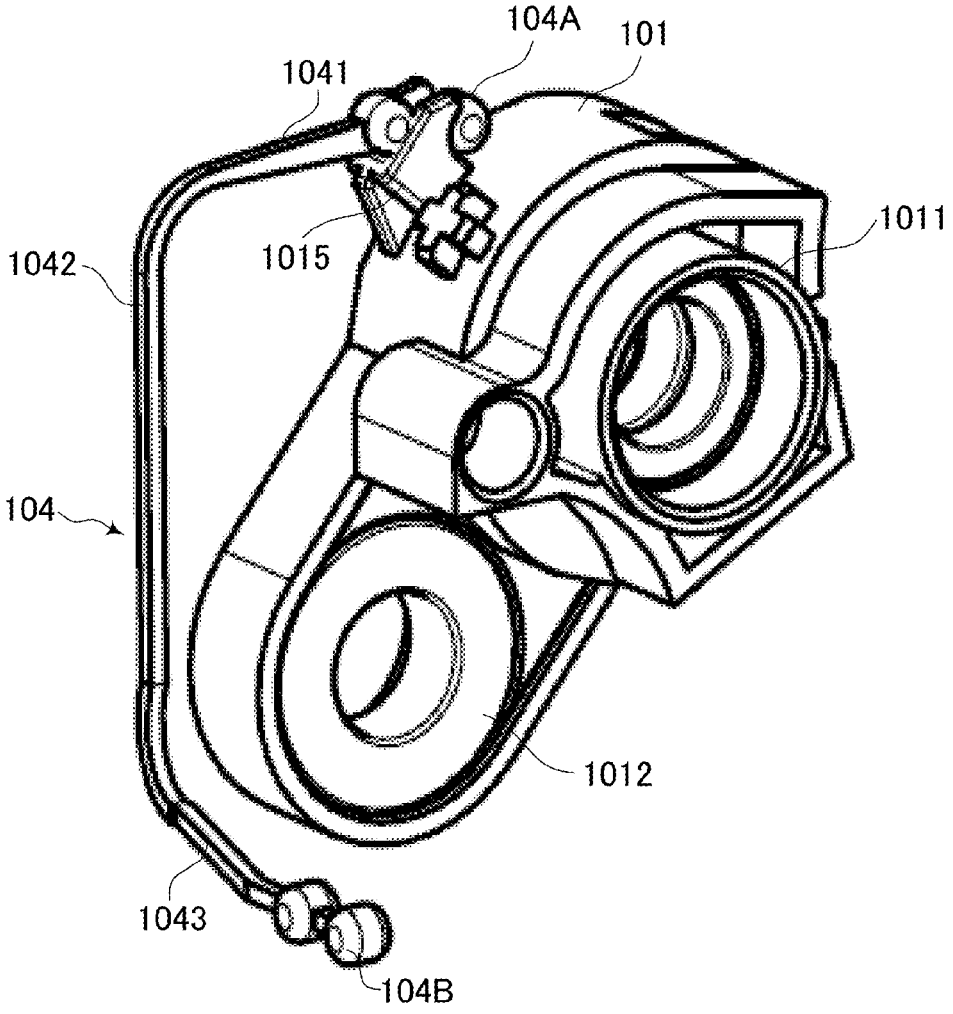
FIG. 7 is a perspective view showing a bearing unit for the developing roller and a magnetic roller.
Figure 8:
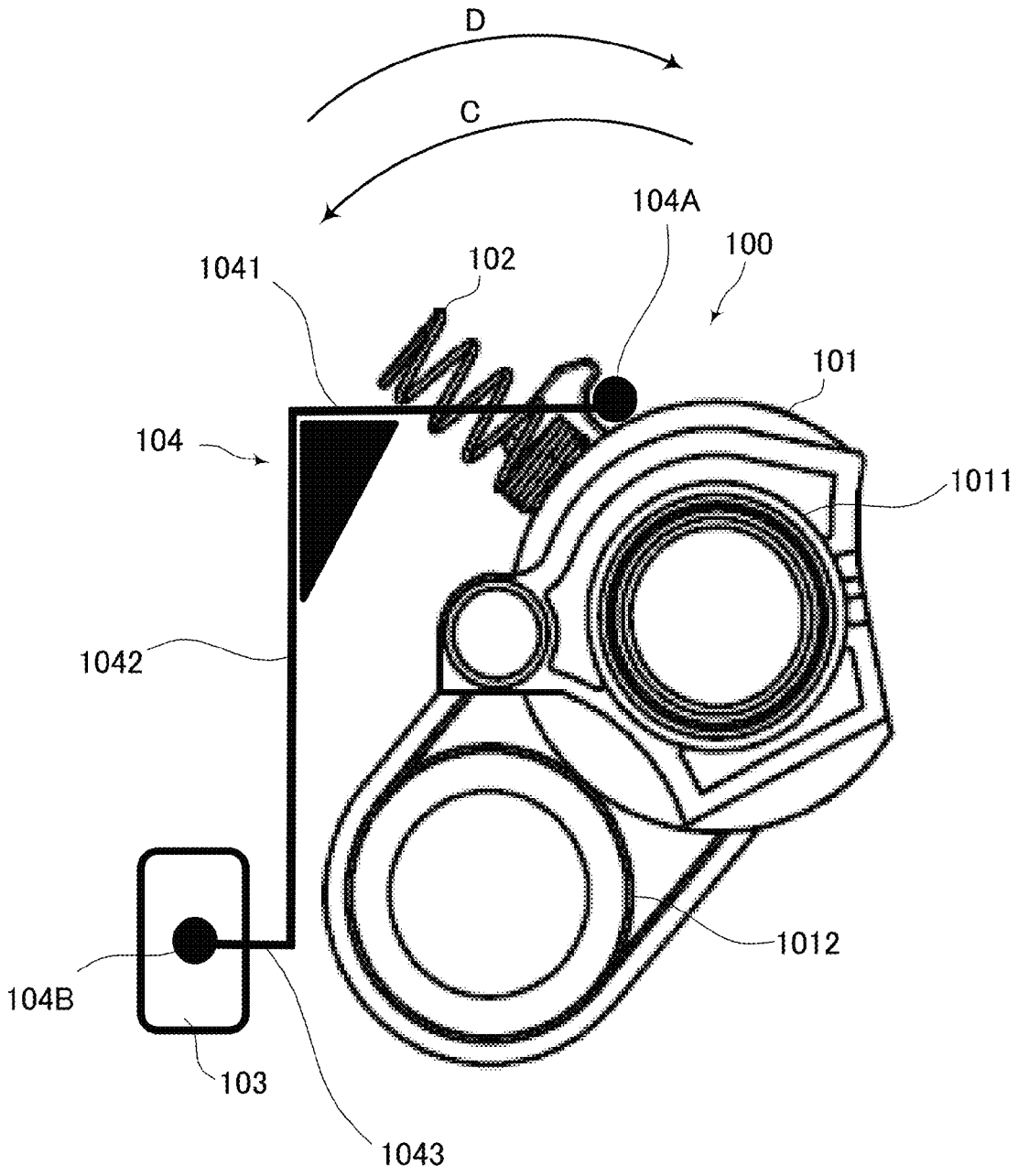
FIG. 8 is a side view showing the bearing unit for the developing roller and the magnetic roller.

Next, a description will be given of a transfer mechanism configured to move the developing roller 24 into and out of contact with the photosensitive drum 121 in the developing device 122 with reference not only to the above FIGS. 2 and 3 but additionally to FIGS. 5 to 8. FIG. 5 is a perspective view showing the transfer mechanism for the developing roller 24. FIG. 6 is a perspective view showing the transfer mechanism for the developing roller 24 as viewed from a different direction from in FIG. 5. FIG. 7 is a perspective view showing the bearing unit for the developing roller 24 and the magnetic roller 23. FIG. 8 is a side view showing the bearing unit for the developing roller 24 and the magnetic roller 23.

The transfer mechanism 100 is a mechanism configured to move the developing roller 24 between a contact position where the developing roller 24 is in contact with the photosensitive drum 121 and a separate position where the developing roller 24 is away from the photosensitive drum 121.

The transfer mechanism 100 includes the pair of bearing units 101, a pair of pressing members 102, a shaft member 103, an urging member 1032, a pair of wire members (an example of the rod member) 104, and a guide portion 28.

The pair of bearing units 101 support the developing roller 24 in their respective developing roller-dedicated bearings 1011 to allow rotation of the developing roller 24. The pair of bearing units 101 also support the magnetic roller 23 in their respective magnetic roller-dedicated bearings 1012 to allow rotation of the magnetic roller 23. The pair of bearing units 101 are pivotally mounted to the housing 20 so that the axis of rotation of the magnetic roller 23 is their pivot axis.

Each of the pair of pressing members 102 is made of, for example, a pressing spring, mounted at one end to the housing 20, and mounted at the other end to the associated bearing unit 101. Each of the pair of pressing members 102 is configured to press the associated bearing unit 101 toward bringing it close to the photosensitive drum 121. By the action of the pair of pressing members 102, the pair of bearing units 101 pivotally move, with the axis of rotation of the magnetic roller 23 as their pivot axis, in directions toward and away from the photosensitive drum 121 (in the directions of the arrows C and D shown in FIG. 8).

The shaft member 103 is mounted to the housing 20 reciprocally movably in an axial direction of the developing roller 24.

Each of the pair of wire members 104 is made of a bowable, rod-shaped material. Each wire member 104 is mounted at one end to the associated bearing unit 101 and mounted at the other end to the shaft member 103, thus connecting the bearing unit 101 and the shaft member 103.

The pair of bearing units 101 are fitted onto both axial ends of the developing roller 24 and the magnetic roller 23. The pair of wire members 104 are mounted to the pair of respective bearing units 101.

As shown in FIG. 3, the exterior wall 201 of the housing 20 is provided with the guide portion 28 configured to guide the shaft member 103 in the axial direction. The guide portion 28 includes a plurality of upper guide portions 281 and a plurality of lower guide portions 282.

The upper guide portions 281 have a raised shape projecting laterally from the exterior wall 201 as shown in FIG. 3. The plurality of upper guide portions 281 are arranged in alignment with each other in the axial direction and next to a region of the exterior wall 201 where the shaft member 103 is disposed. Specifically, the upper guide portions 281 are provided at locations where their under surfaces make contact with the top surface of the shaft member 103 disposed on the exterior wall 201.

The lower guide portions 282 also have a raised shape projecting upward from the exterior wall 201 as shown in FIG. 3. The plurality of lower guide portions 282 are also arranged in alignment with each other in the axial direction and next to the region of the exterior wall 201 where the shaft member 103 is disposed. Specifically, the lower guide portions 282 are provided at locations where their inside surfaces make contact with the outside surface of the shaft member 103 disposed on the exterior wall 201.

Thus, the top surface of the shaft member 103 is supported by the plurality of upper guide portions 281 and the outside surface of the shaft member 103 is supported by the plurality of lower guide portions 282. By the support of the upper and lower guide portions, the shaft member 103 is guided slidably in the axial direction on the exterior wall 201.

Furthermore, the urging member 1032 is attached to the shaft member 103. The urging member 1032 is formed of a pull-back spring or the like, mounted at one end to the shaft member 103, and mounted at the other end to one of the plurality of lower guide portions 282. Thus, the shaft member 103 is configured so that, under the urging force of the urging member 1032, its position on the exterior wall 201 of the housing 200 stays at the position shown in FIGS. 3 and 4. In other words, the position of the shaft member 103 shown in FIG. 3 indicates a position where the shaft member 103 is maximally retracted in the direction of the arrow A in FIG. 3, i.e., towards a side surface 20A of the housing 20. Hereinafter, this position is referred to as a home position.

The developing device 122 can be mounted to the image forming apparatus 1 by inserting it into the image forming apparatus 1 so that the side surface 20A of the housing 20 is located on the front side of the image forming apparatus 1 (the near side of an operator standing in front of the image forming apparatus 1).

Furthermore, the shaft member 103 is configured so that when in the home position, one end 1035 thereof is exposed from the side surface 20A of the housing 20. The shaft member 103 is further configured to be movable in the axial direction (the direction of the arrow B shown in FIG. 3) against the urging force of the urging member 1032 when the exposed one end 1035 thereof is pressed in the axial direction (the direction of the arrow B) from the outside toward the interior of the housing 20. When released from the above pressing, the shaft member 103 moves in the direction of the arrow A under the urging force of the urging member 1032 to return to the home position.

Each wire member 104 includes a first rod portion 1041, a second rod portion 1042, and a third rod portion 1043. The first rod portion 1041 extends in a direction in which the pair of bearing units 101 move into and out of contact with the photosensitive drum 121, specifically in this embodiment, in a direction toward the shaft member 103 on the exterior wall 201. The second rod portion 1042 bends from the first rod portion 1041 to form a bend therebetween and then extends toward the location where the shaft member 103 is disposed.

In this embodiment, the second rod portion 1042 bends in a direction perpendicular to the first rod portion 1041 and then extends downward in the figures shown. The third rod portion 1043 further bends from the second rod portion 1042 to form a bend therebetween and then extends in the axial direction of the developing roller 24 from the bend. In this embodiment, the third rod portion 1043 bends in a direction perpendicular to the second rod portion 1042 and then extends in the direction of movement of the shaft member 103.

Furthermore, a distal end 104A of the wire member 104 located close to the first rod portion 1041 is engaged to an engagement portion 1015 provided at the top of the bearing unit 101. On the other hand, another distal end 104B of the wire member 104 located close to the third rod portion 1043 is engaged to the shaft member 103.

As described previously, the pair of bearing units 101 are fitted onto both axial ends of the developing roller 24 and the magnetic roller 23 and the pair of wire members 104 are mounted to the shaft member 103.

Figure 9A:
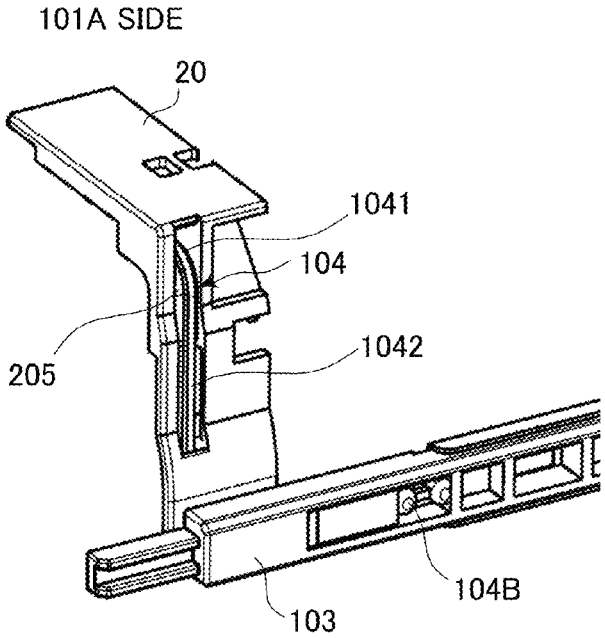
FIG. 9A is a perspective view showing the fitting of a wire member to a portion of a housing located adjacent to one of a pair of bearing units.
Figure 9B:
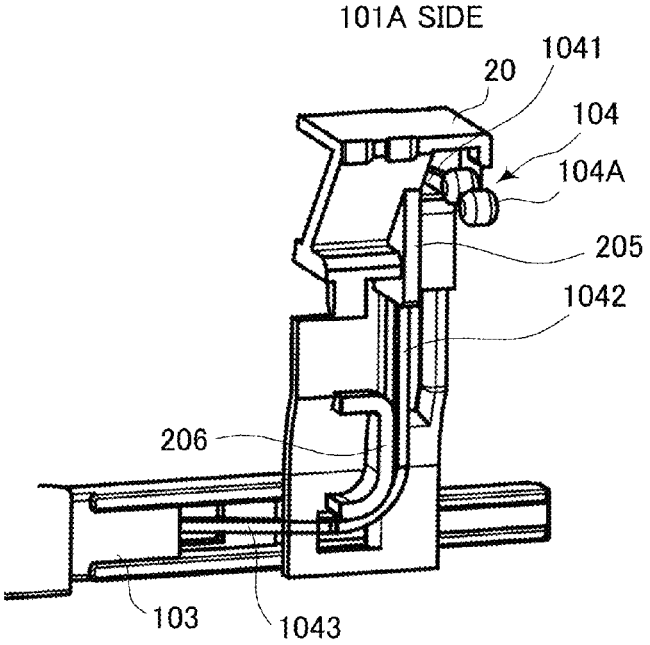
FIG. 9B is a perspective view showing the fitting of the wire member to the portion of the housing located adjacent to the one of the pair of bearing units as viewed at a different angle from in FIG. 9A.

Next, a description will be given of the fitting of the pair of wire members 104 to the housing 20. FIG. 9A is a perspective view showing the fitting of the wire member 104 to a portion of the housing 20 located adjacent to one bearing unit 101A of the pair of bearing units 101 and FIG. 9B is a perspective view showing the fitting of the wire member 104 to the portion of the housing 20 located adjacent to the one bearing unit 101A as viewed at a different angle from in FIG. 9A. FIG. 1 OA is a perspective view showing the fitting of the wire member 104 to a portion of the housing 20 located adjacent to the other bearing unit 101B of the pair of bearing units 101 and FIG. 10B is a perspective view showing the fitting of the wire member 104 to the portion of the housing 20 located adjacent to the other bearing unit 101B as viewed at a different angle from in FIG. 10A.

As shown in FIGS. 9A and 9B, as for the wire member 104 to be mounted to the bearing unit 101A, first, its bend between the first rod portion 1041 and the second rod portion 1042 is supported by a support portion 205 provided on the housing 20. Furthermore, its bend between the second rod portion 1042 and the third rod portion 1043 is supported by another support portion 206 provided on the housing 20. These support portions 205, 206 have shapes along the shapes of the relevant bends.

With the bends supported by the support portions 205, 206 in the above manner, the one distal end 104A of the wire member 104 is attached to the bearing unit 101 and the other distal end 104B is attached to the shaft member 103. The wire member 104 is configured to stay stretched, without bowing, while the shaft member 103 is in the home position by urging of the urging member 1032 in the direction of the arrow A shown in FIG. 3.

Figure 10A:
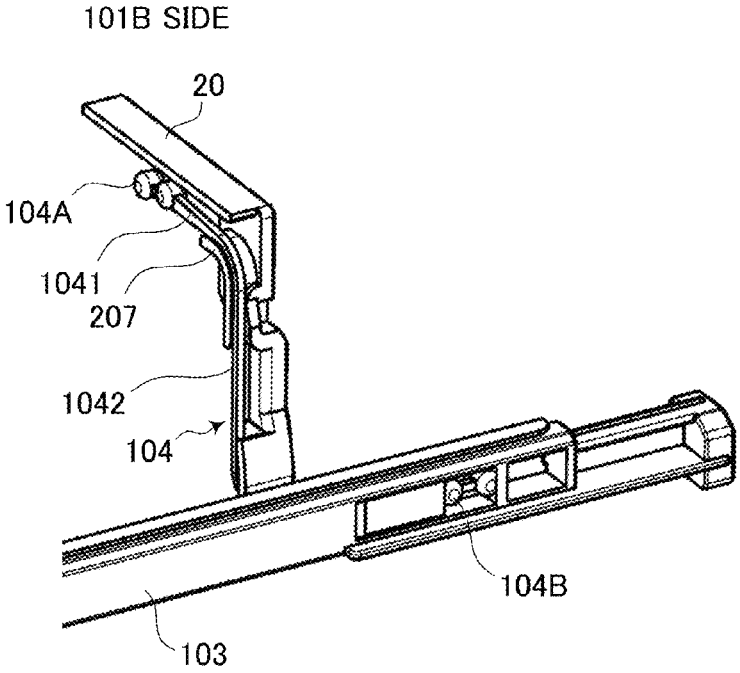
FIG. 10A is a perspective view showing the fitting of a wire member to a portion of the housing located adjacent to the other of the pair of bearing units.
Figure 10B:
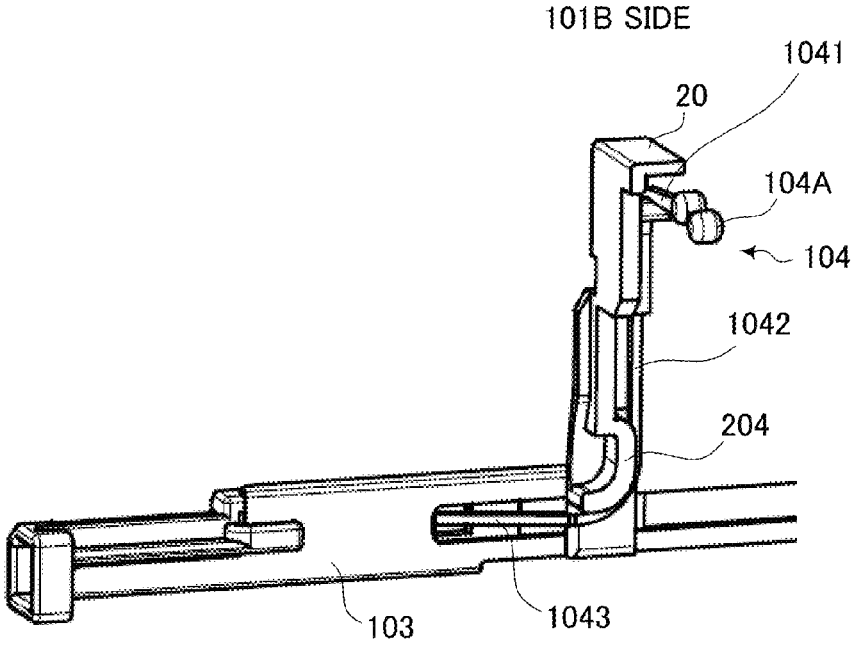
FIG. 10B is a perspective view showing the fitting of the wire member to the portion of the housing located adjacent to the other of the pair of bearing units as viewed at a different angle from in FIG. 10A.

As shown in FIGS. 10A and 10B, also as for the wire member 104 to be mounted to the bearing unit 101B, its bend between the first rod portion 1041 and the second rod portion 1042 is supported by a support portion 207 provided on the housing 20. Furthermore, its bend between the second rod portion 1042 and the third rod portion 1043 is supported by another support portion 204 provided on the housing 20. These support portions 207, 204 have shapes along the shapes of the relevant bends.

With the bends supported by the support portions 207, 204 in the above manner, the one distal end 104A of the wire member 104 is attached to the bearing unit 101 and the other distal end 104B is attached to the shaft member 103. Therefore, like the wire member 104 mounted to the bearing unit 101A, the wire member 104 is configured to stay stretched, without bowing, while the shaft member 103 is in the home position.

While the shaft member 103 is in the home position, the stretching of the wire members 104 and the shapes of the first rod portions 1041, the second rod portions 1042, and the third rod portions 1043 of the wire members 104 cause the urging force of the urging member 1032 in the direction of the arrow A in FIG. 3 to be converted to an urging force in the direction of pivotal movement of the bearing units 101 shown by the arrow C in FIG. 8.

In this relation, the urging member 1032 is configured to have an urging force greater than the pressing force of the pair of pressing members 102 pressing the pair of bearing units 101. Therefore, in the home position, the pair of bearing units 101 are kept pivotally moved to a pivotable limit in the direction of the arrow C in FIG. 8.

Referring again to FIGS. 3, 5, and 7, a description will be given of the pivotal movement of the bearing units 101 in conjunction with the movement of the shaft member 103.

When no external pressing force is applied to the shaft member 103, the transfer mechanism 100 configured as described previously is located in the home position (the position shown in FIG. 3) under the urging force of the urging member 1032.

When in this state the one end 1035 of the shaft member 103 exposed from the side surface 20A of the housing 20 is pressed in the direction of the arrow B, the shaft member 103 moves in the axial direction of the developing roller 24 (the direction of the arrow B) against the urging force of the urging member 1032 while being guided by the guide portion 28.

Concurrently, the above-described each wire member 104, the distal end 104B of which is attached to the shaft member 103, is also pressed in the direction of the arrow B by the movement of the shaft member 103. Thus, the third rod portion 1043 of each wire member 104 experiences a pressing force through the distal end 104B with the movement of the shaft member 103. This pressing force on the third rod portion 1043 bows the second rod portion 1042 perpendicular to the third rod portion 1043. Thus, the pair of wire members 104 become unstretched.

When the pair of wire members 104 become unstretched, the urging force of the wire members 104 in the direction of the arrow C shown in FIG. 8, i.e., toward moving the developing roller 24 away from the photosensitive drum 121, is reduced. The pressing force of the pressing members 102 is set to be greater than the urging force of the pair of wire members 104 and the urging member 1032 when the wire members 104 become unstretched. Therefore, when the pair of wire members 104 become unstretched, the pair of bearing units 101 are pivotally moved in the direction of the arrow D shown in FIG. 8, i.e., toward moving the developing roller 24 close to the photosensitive drum 121, by the pressing force of the pressing members 102. The total length and amount of bowing of each wire member 104 and the urging force of the urging member 1032 are set so that when the pair of bearing units 101 are pivotally moved in the direction of the arrow D in the above manner by the unstretching of the wire members 104, they can be moved to a position where the developing roller 24 is in contact with the photosensitive drum 121.

Referring to FIG. 3, a description will next be given to the relation between the opening/closing of an exterior cover provided at the front of the apparatus body 11 of the image forming apparatus 1 and the movement of the shaft member 103.

For example, for each image forming unit of the image forming apparatus 1, an exterior cover 11A openable to expose the interior of the apparatus body 11, i.e., the image forming section 12, is provided at the front of the apparatus body 11. The inside wall surface of the exterior cover 11A has a raised portion 11B projecting toward the image forming section 12 and facing the associated developing device 122 of the image forming section 12. The raised portion 11B is formed to have such a location and an amount of projection that when the exterior cover 11A is closed, the raised portion 11B abuts on the end 1035 of the shaft member 103 exposed from the side surface 20A of the associated developing device 122 to press the end 1035 in the direction of the arrow B in FIG. 3, i.e., toward the interior of the developing device 122.

Therefore, the pair of wire members 104 of the transfer mechanism 100 for each developing device 122 are bowed by the movement of the shaft member 103 in the direction of the arrow B caused by the pressing of the raised portion 11B. Thus, the pressing force of the pressing members 102 acts on the bearing units 101, so that the bearing units 101 are pivotally moved to the position where the developing roller 24 is in contact with the photosensitive drum 121.

When in this state an operator opens the exterior cover 11A for the maintenance of the image forming section 12 or the developing device 122 to expose the developing device 122, the end 1035 of the shaft member 103 exposed from the side surface 20A of the developing device 122 is released from the pressing force of the raised portion 11B provided on the exterior cover 11A. Thus, the shaft member 103 moves to the home position under the urging force of the urging member 1032. As a result, the pair of wire members 104 become stretched, so that the pair of bearing units 101 pivotally move, against the pressing force of the pressing member 102, to the position where the developing roller 24 is away from the photosensitive drum 121.

In this manner, in the case where at the time of maintenance or so on the operator pulls out the developing device 122 in the direction of the arrow A in FIG. 3 from the interior of the image forming apparatus 1, the developing roller 24 can be kept away from the photosensitive drum 121.

As thus far described, this embodiment enables a smoother operation of moving the developing roller 24 into and out of contact with the photosensitive drum 121. Therefore, in replacing the drum unit or the developing device 122, the developing roller 24 can be moved away from the photosensitive drum 121 to prevent their damage due to striking each other. Thus, the operator can pull the developing roller 24 or the drum unit out of the apparatus body 11 without fear of the damage, which improves the workability in replacing the drum unit or the developing device 122. For example, not only the serviceman's work of replacing the developing device 122 can be simplified but also users can easily perform the work of replacing the developing device 122, thus reducing the replacement work time. Furthermore, as seen from the above, the transfer mechanism 100 can be formed of a simple mechanism including the pair of bearing units 101, the pair of pressing members 102, the shaft member 103, the urging member 1032, the pair of wire members (an example of the rod member) 104, and the guide portion 28. Therefore, the assembly of the transfer mechanism 100 is kept from getting complicated.

For example, in the devices and mechanisms described in BACKGROUND, the magnitude of the force of pressing the developing roller against the photosensitive drum and the dimensional tolerances and assembly errors of components, including an arm member and a shaft member, may increase the load on the shaft member. In this case, the shaft member may not smoothly move, resulting in failure to stably move the developing roller into and out of contact with the photosensitive drum. Furthermore, the developing roller transfer mechanism described in BACKGROUND has the problem that the slide auxiliary member has a small size and is therefore difficult to assemble.

Unlike these known devices and mechanisms, the above-described embodiment does not complicate the structure and is therefore excellent in assemblability. In addition, the above-described embodiment can make the operation of moving the developing roller into and out of contact with the image carrier smoother to improve the workability of replacement of the drum unit and the developing device.

The present disclosure is not limited to the above embodiment and can be modified in various ways. For example, although the description of the above embodiment is given taking a color multifunction peripheral as an example of the image forming apparatus according to the present disclosure, the example is merely illustrative and the image forming apparatus may be a black-and-white multifunction peripheral or any other electronic image forming apparatus, such as a printer, a copier or a facsimile machine.

The structures, configurations, and processing shown in the above embodiment with reference to FIGS. 1 to 10 are merely illustrative of the present disclosure and not intended to limit the present disclosure to the above structures, configurations, and processing.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A developing device comprising:

a developing roller configured to supply a developer to an electrostatic latent image formed on an image carrier; and a transfer mechanism configured to transfer the developing roller between a contact position where the developing roller is in contact with the image carrier and a separate position where the developing roller is away from the image carrier, wherein the transfer mechanism comprises:

a bearing unit supporting a rotary shaft of the developing roller to allow rotation of the rotary shaft and being pivotally supported by a housing covering the developing roller and the transfer mechanism;

a pressing member configured to press the bearing unit toward bringing the bearing unit close to the image carrier;

a shaft member mounted to the housing reciprocally movably in an axial direction of the developing roller;

an urging member urging the shaft member unidirectionally in the axial direction; and a rod member connecting the bearing unit and the shaft member, the rod member being configured to experience a unidirectional urging force of the urging member to urge the bearing unit toward moving away from the image carrier against a pressing force of the pressing member and, upon release of the urging force of the urging member resulting from movement of the shaft member in a direction opposite to the unidirectional urging force, move the bearing unit close to the image carrier under the pressing force of the pressing member.

2. The developing device according to claim 1, further comprising a magnetic roller configured to supply the developer to the developing roller and disposed on a side of the developing roller opposite to the image carrier to face in parallel with the developing roller, wherein the bearing unit further supports the magnetic roller to allow rotation of the magnetic roller and is capable of pivotal movement with an axis of rotation of the magnetic roller as a pivot axis of the bearing unit.

3. The developing device according to claim 2, wherein one end of the shaft member is exposed from the housing, and the shaft member is further configured to, when the exposed one end thereof is pressed in the axial direction, move from the distal end of the third rod portion toward the bend between the second and third rod portions.

4. An image forming apparatus comprising:

the developing device according to claim 3;

the image carrier configured to be supplied with the developer from the developing roller;

an exposure device configured to expose a surface of the image carrier to light to generate the electrostatic latent image;

an image transfer device configured to transfer from the image carrier to an image transfer member a toner image formed by developing the electrostatic latent image with the developer supplied from the developing roller;

an exterior cover provided on an apparatus body of the image forming apparatus, the exterior cover being openable to expose an image forming section including the developing device; and a raised portion provided on an inside wall surface of the exterior cover to project toward the image forming section and facing the developing device of the image forming section, wherein the one end of the shaft member is pressed by the raised portion during closure of the exterior cover and released from a pressing force of the raised portion during opening of the exterior cover.

5. The developing device according to claim 2, wherein a pair of the bearing units are disposed at both respective ends of the developing roller, a pair of the rod members are provided at the pair of the respective bearing units, and the distal end of the third rod portion of each of the pair of the rod members is mounted to the shaft member.

6. The developing device according to claim 1, wherein the rod member is made of a bowable material and includes a first rod portion extending in a direction in which the bearing unit moves into and out of contact with the image carrier, a second rod portion bending from the first rod portion to form a bend therebetween and then extending toward the shaft member disposed close to the magnetic roller, and a third rod portion bending from the second rod portion to form a bend therebetween and then extending in the axial direction from the bend, the housing is provided with a support portion supporting the bend formed between the first rod portion and the second rod portion, the third rod portion is mounted at a distal end thereof to the shaft member, and the shaft member is configured to, when in a home position thereof, hold the rod member stretched and, when moving from the home position in the axial direction from the distal end of the third rod portion toward the bend between the second and third rod portions, bow the rod member to move the bearing unit close to the image carrier under the pressing force of the pressing member.

7. An image forming apparatus comprising:

the developing device according to claim 1;

the image carrier configured to be supplied with the developer from the developing roller;

an exposure device configured to expose a surface of the image carrier to light to generate the electrostatic latent image; and an image transfer device configured to transfer from the image carrier to an image transfer member a toner image formed by developing the electrostatic latent image with the developer supplied from the developing roller.

* * * * *